US011415289B2

(12) United States Patent
Taudt et al.

(10) Patent No.: US 11,415,289 B2
(45) Date of Patent: Aug. 16, 2022

(54) ILLUMINATION DEVICE FOR A MOTOR VEHICLE HEADLIGHT

(71) Applicant: ZKW Group GmbH, Wieselburg (AT)

(72) Inventors: Lukas Taudt, Wieselburg (AT); Nina Brauner, Altlengbach (AT); Mathias Schragl, Zarnsdorf (AT); Christoph Längauer, Lunz am See (AT); Johann Höfler, Wieselburg (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 15/734,528

(22) PCT Filed: May 14, 2019

(86) PCT No.: PCT/EP2019/062307
§ 371 (c)(1),
(2) Date: Dec. 2, 2020

(87) PCT Pub. No.: WO2019/233713
PCT Pub. Date: Dec. 12, 2019

(65) Prior Publication Data

US 2021/0231283 A1 Jul. 29, 2021

(30) Foreign Application Priority Data

Jun. 4, 2018 (EP) ..... 18175740

(51) Int. Cl.
*F21S 41/663* (2018.01)
*F21S 41/24* (2018.01)
(Continued)

(52) U.S. Cl.
CPC ..... *F21S 41/663* (2018.01); *F21S 41/143* (2018.01); *F21S 41/24* (2018.01); *F21S 41/29* (2018.01); *F21Y 2115/00* (2016.08)

(58) Field of Classification Search
CPC ..... F21S 41/663; F21S 41/24; F21S 41/143; F21S 41/29; F21Y 2115/00
See application file for complete search history.

(56) References Cited

U.S. PATENT DOCUMENTS

2015/0085523 A1* 3/2015 Gurtl ..... F21S 41/153 362/607
2015/0124469 A1* 5/2015 Krenn ..... G02B 6/0008 362/511

(Continued)

FOREIGN PATENT DOCUMENTS

CN 108397743 A * 8/2018 ..... F21S 41/285
EP 3339720 A1 6/2018
FR 3056700 A1 3/2018

OTHER PUBLICATIONS

European Search Report for EP Application No. 18175740, dated Nov. 19, 2018.

(Continued)

*Primary Examiner* — Erin Kryukova
(74) *Attorney, Agent, or Firm* — Eversheds Sutherland (US) LLP

(57) ABSTRACT

The invention relates to an illumination device for a motor vehicle headlight, said illumination device comprising the following: —multiple light sources (10) which are designed to emit light beams in a main emission direction, —a primary optical system (100) having multiple light-guiding elements (110), said light-guiding elements (110) being arranged in the main emission direction of the light sources (10) and each having a light entry face (120) into which the light beams of the light sources can be fed, and a light exit face (130), the light-guiding elements (110) opening into a common light exit face (130), and—a holder (200) which is designed to hold the light entry faces (120) of the light-guiding elements (110) in position in relation to the light (Continued)

Figure 1:
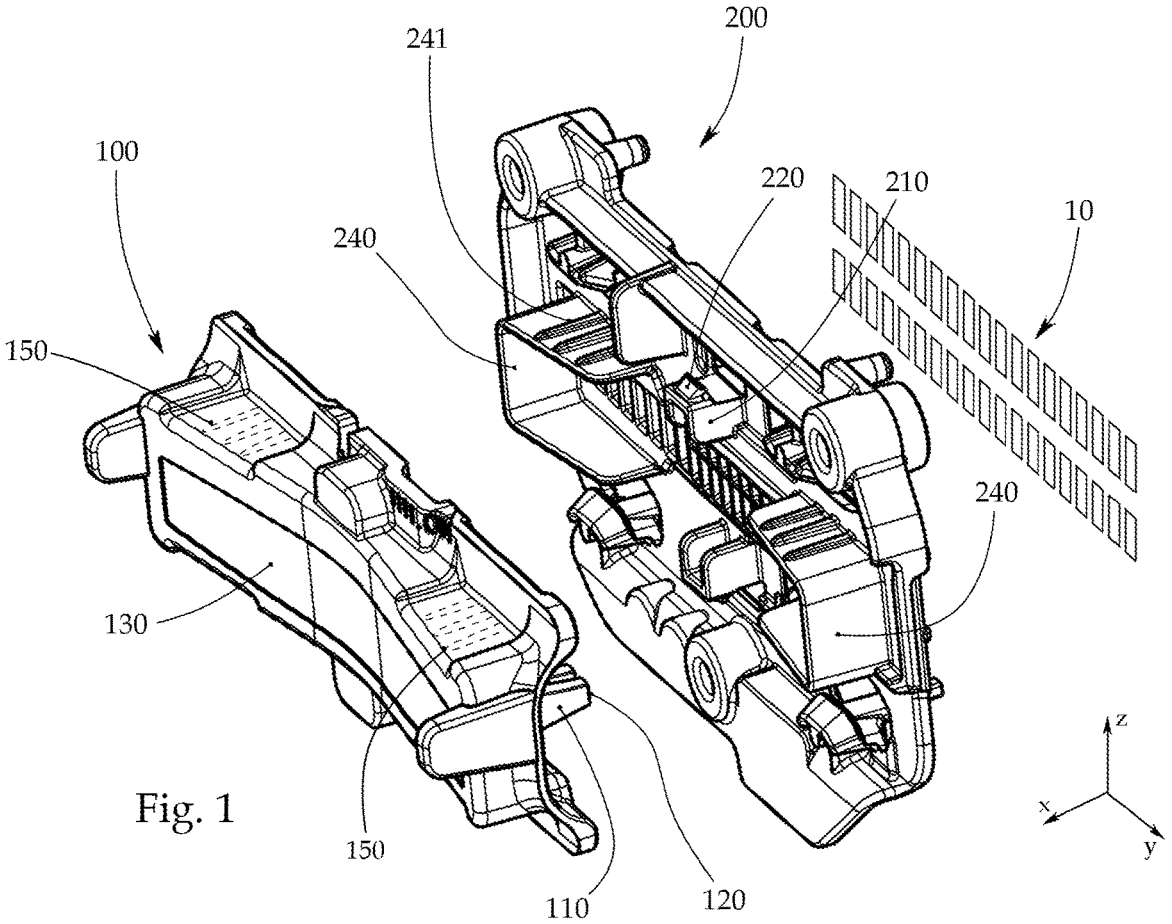

sources (10), the holder (200) having at least one latching element (210) formed with a latching tab (220) to fasten the primary optical system (100), the latching tab (220) being designed to engage in an undercut (140) associated with the latching tab (220) and provided on the primary optical system (100).

12 Claims, 3 Drawing Sheets

(51) Int. Cl.

| | |
|---|---|
| ***F21S 41/143*** | (2018.01) |
| ***F21S 41/29*** | (2018.01) |
| ***F21Y 115/00*** | (2016.01) |

(56) References Cited

U.S. PATENT DOCUMENTS

| | | | | |
|---|---|---|---|---|
| 2015/0192264 | A1* | 7/2015 | Holzl | F21S 41/143<br>362/511 |
| 2015/0323146 | A1 | 11/2015 | Krenn | |
| 2015/0377440 | A1* | 12/2015 | Reitegger | F21S 41/153<br>362/520 |
| 2016/0273727 | A1 | 9/2016 | Maier et al. | |
| 2018/0264994 | A1* | 9/2018 | Stoehr | F21S 41/265 |

OTHER PUBLICATIONS

International Search Report for PCT/EP2019/062307, dated Jul. 23, 2019.

* cited by examiner

ILLUMINATION DEVICE FOR A MOTOR VEHICLE HEADLIGHT

The invention relates to an illumination device for a motor-vehicle headlamp, which illumination device comprises the following:

- a plurality of light sources, which are configured to emit light beams in a main emission direction,
- a primary optical element having a plurality of light-conducting bodies, which light-conducting bodies are arranged in the main emission direction of the light sources and respectively have a light entry face, into which the light beams of the light sources can be fed, and a common light exit face, the light-conducting bodies opening into the common light exit surface, and
- a holder, which is configured to hold the light entry faces of the light-conducting bodies in position with respect to the light sources.

Moreover, the invention relates to a light module having at least one illumination device according to the invention.

The invention further relates to a motor-vehicle headlamp having at least one illumination device according to the invention or having at least one light module having at least one illumination device according to the invention.

Usually, the above-mentioned illumination devices are used in connection with light modules or motor-vehicle headlamps in order to generate light distributions. To this end, primary optical elements made from glass are generally used, using which simple geometries can be realized for primary optical elements. If, by contrast, more complex geometries are necessary for a primary optical element, then the use of glass is often unsuitable for this.

It has been established that, instead of glass, transparent, particularly highly transparent, light-conducting and shapeable plastics are well suited as a material for the production of complex geometries. Poly(organo)siloxanes are particularly well suited for producing complex adapter optical elements and it is particularly advantageous if the primary optical element is produced from a silicone material.

However, a disadvantage of the use of such plastics, particularly of silicone, for producing primary optical elements, is that such a primary optical element does not have the strength of a glass body. From optical viewpoints, it is however advantageous or necessary that the primary optical element has a shape, which is as stable as possible, particularly with regards to the positioning of its light entry face or its light entry faces with respect to a lamp or light sources. An offset of the light entry faces with respect to the lamp or light sources, leads to undesired light losses for example, particularly if light-emitting diodes are used as light sources.

An offset of the light exit faces of the adapter optical element may in turn lead to the light image formed not corresponding to the desired requirements.

It is an object of the invention to provide an improved illumination device.

This object is achieved in that the holder has at least one latching element for fastening the primary optical element, wherein the latching element is configured to engage in a mating latching element provided on the primary optical element, which is assigned to the latching element.

This ensures that no further, additional component, as is often used in the prior art, is needed for holding the primary optical element on the holder.

The illumination device is preferably a "pixel light device", wherein the light sources are arranged in rows and columns.

In such a "pixel light device", the light sources can be controlled independently of one another, as a result of which different light distributions can be generated, particularly an adaptive main beam light distribution.

It may be provided that the at least one latching element has a catch or is constructed as an undercut.

It may also be provided that the mating latching element is a catch or is constructed as an undercut.

In a practical embodiment, it may be provided that the at least one latching element has a catch and the mating latching element is constructed as an undercut.

Preferably, in the case of a primary optical element constructed to be elongated transverse to the main emission direction of the light sources, a plurality of undercuts can be arranged along the longitudinal axis of the primary optical element. Here, latching elements are arranged on the holder in accordance with the number of undercuts.

Preferably, at least two latching elements with respectively assigned undercut may be provided.

In particular, undercuts or corresponding latching elements are arranged above or below the light exit face or the light sources, wherein "above"/"below" relate to the previously mentioned longitudinal axis of the primary optical element transverse to the main emission direction of the light sources in the assembled state of the illumination device.

"Main emission direction" is to be understood as the direction in which the light sources emit light most strongly or most as a consequence of their directionality.

It may also be provided that the latching element is constructed as an undercut and the mating latching element has a catch.

It may advantageously be provided that the at least one latching element is produced in one piece with the holder.

It may provided that the holder is made from a thermoplastic.

Thermoplastics are better or more easily shapeable compared to thermoset plastics.

It is particularly advantageous in this case, if the holder is made from a material that shadows scattered light, that is to say a non-transparent material, e.g. from black plastic, particularly—for example black—thermoplastic, so that scattered light from adjacent light sources in particular is shadowed.

A further, alternative or preferably additional measure in order to prevent light losses into the position holder is that the position holder is constructed in such a manner that the contact surface of a light-conducting body (or the light-conducting bodies) with the position holder is as small as possible.

The light-conducting body therefore only contacts the position holder in a narrow contact region, for example in a line running around the respective optical waveguide.

Advantageously, the primary optical element may be made in one piece from a transparent, light-conducting and shapeable plastic.

"One piece" is to be understood to mean a production of the primary optical element from one piece, preferably by means of an injection moulding method.

It is noted that the primary optical element with all of its "components", for example the light exit face, the light-conducting bodies, the mating latching elements and further "components" arranged on the primary optical element has been produced in one piece or from one piece in a production process or method.

In an expedient embodiment, the primary optical element may be made from a silicone material.

Owing to the elastomeric properties of a silicone material, removal from the mould during the production of the primary optical element is possible without an additional slider, as the primary optical element is preferably produced by means of an injection moulding method.

Likewise, it may be advantageous if the primary optical element is made from a poly(organo)siloxane.

It may advantageously be provided that the holder has an accommodating section having at least one opening, in which the light-conducting bodies can be accommodated and positioned.

The individual light-conducting bodies can be held particularly well in their position with respect to the light sources if the holder has an opening for each light-conducting body, in which the assigned light-conducting body is accommodated and positioned precisely.

The openings are holes or mounts in the holder, with an exactly matched cross section for the respective light-conducting body; these are pushed into the assigned openings and held by the holder in the desired position.

It may be provided that the holder has openings corresponding to the number of light-conducting bodies, which are each assigned to a light-conducting body.

It may be beneficial if the holder accommodates the light-conducting bodies at their end regions facing the light entry faces.

In this case, the light-conducting bodies protrude slightly rearwards out of the mount or terminate flush with the holder.

It may further be provided that the holder has at least one positioning wall protruding in the main emission direction, which is configured to engage into a depression provided on the primary optical element.

"Wall" is fundamentally to be understood as not only a projection in one plane. This term may also mean a coming together of a plurality of planar walls, which are arranged at right angles to one another for example and/or form a type of open block, that is to say together form a U shape.

It may be provided that the positioning walls have the same or different heights, in particular, gradual height differences are also possible.

The at least one positioning wall in general ensures a further stability of the primary optical element in the assembled state of the illumination device, so that vibration transverse to the main emission direction of the light sources can be prevented to the greatest extent possible.

It may be provided that, in the main emission direction, at least one positioning wall is arranged to the side of the accommodating section of the holder in each case.

In this case, it may be beneficial if at least one projection is arranged on the at least one positioning wall, which projection extends longitudinally in the direction of the main emission direction and is configured to engage in a positive-fitting manner into a guide groove in the primary optical element, which is assigned to the at least one projection.

It has been established that the at least one projection brings about an additional stability in the fastened state of the primary optical element on the holder.

Furthermore, it may be provided that a material, which has a lower refractive index than the material of the light-conducting bodies, is inserted in each case into the openings between the holder and the light-conducting bodies.

It is particularly advantageous if the material with a lower refractive index surrounds the light-conducting body in such a manner that the light-conducting body does not touch the position holder.

As a result, the limit angle for total internal reflection is increased, so that no or only small amounts of light escape from the light-conducting body.

Preferably, the light-conducting bodies may be of elongated construction, with a larger extent in the main emission direction of the light beams than transversely thereto.

It may be provided that the light-conducting bodies have a cross section that tapers towards their light entry faces.

Due to the cross sections of the light-conducting bodies, which thus increase in size in the main emission direction, the holder can only be pushed onto the light-conducting bodies up to a certain point.

For example, it may be provided that the light-conducting bodies are constructed to have a truncated-cone or trapezoidal shape.

In principle, all polygonal truncated pyramids are possible, e.g. hexagonal, for example in the shape of wedge-shaped honeycombs. The base shape is closely connected with the LED-chip arrangements and the desired light entry and exit.

It may be beneficial if the light sources comprise one or more light-emitting diodes in each case.

It may preferably be provided that each light source comprises one or more light-emitting diodes in each case. Preferably, each light source can be controlled and correspondingly switched on and off, preferably also dimmed, separately. If a light source consists of a plurality of light-emitting diodes, it may also be advantageous if each of the light-emitting diodes can be controlled separately.

Likewise, the object is achieved by means of a light module having at least one illumination device according to the invention.

The object is further achieved using a motor-vehicle headlamp having at least one illumination device according to the invention or a light module having at least one illumination device according to the invention.

A dipped beam and/or a main beam can for example be created using an illumination device according to the invention, wherein the left headlamp and the right headlamp each comprises an illumination device according to the invention for example, using which the left or the right part of the light distribution can be generated in each case. In the light exit direction an additional secondary optical element, generally a lens, is provided in front of the holder in each case, by means of which the respective light distribution can be generated.

The illumination device according to the invention may however also be used for a reversing light.

The invention is explained in more detail in the following on the basis of exemplary drawings.

In the figures

Figure 2:
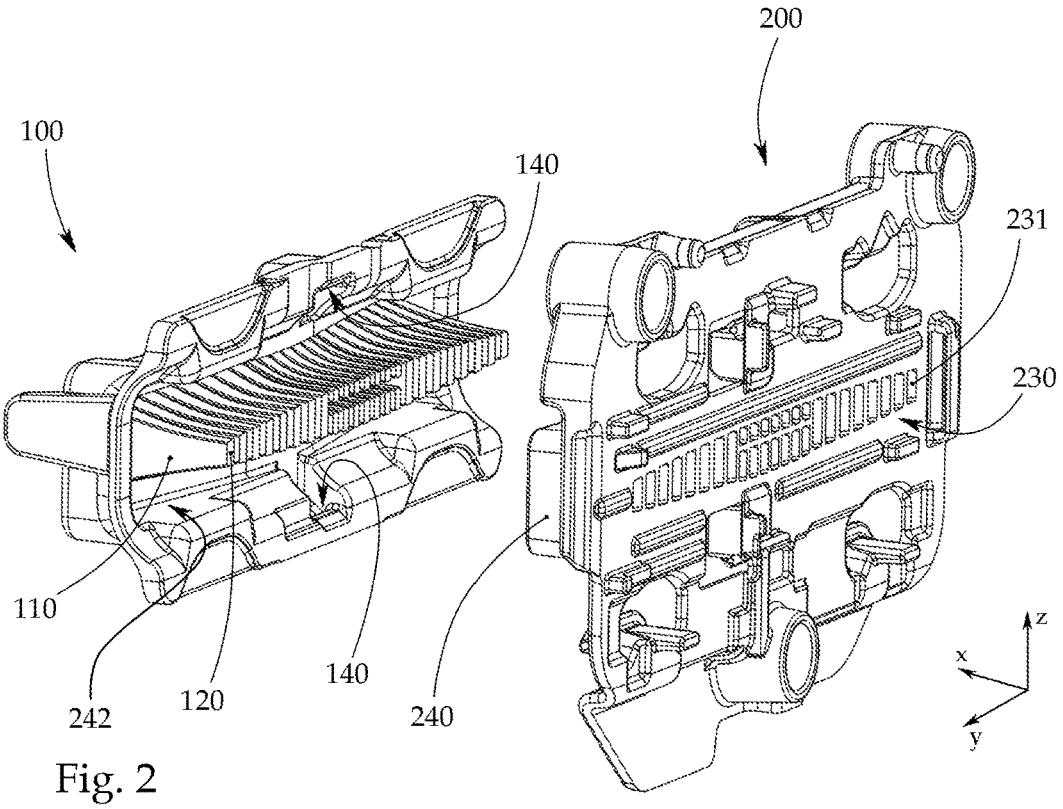
Figure 3:
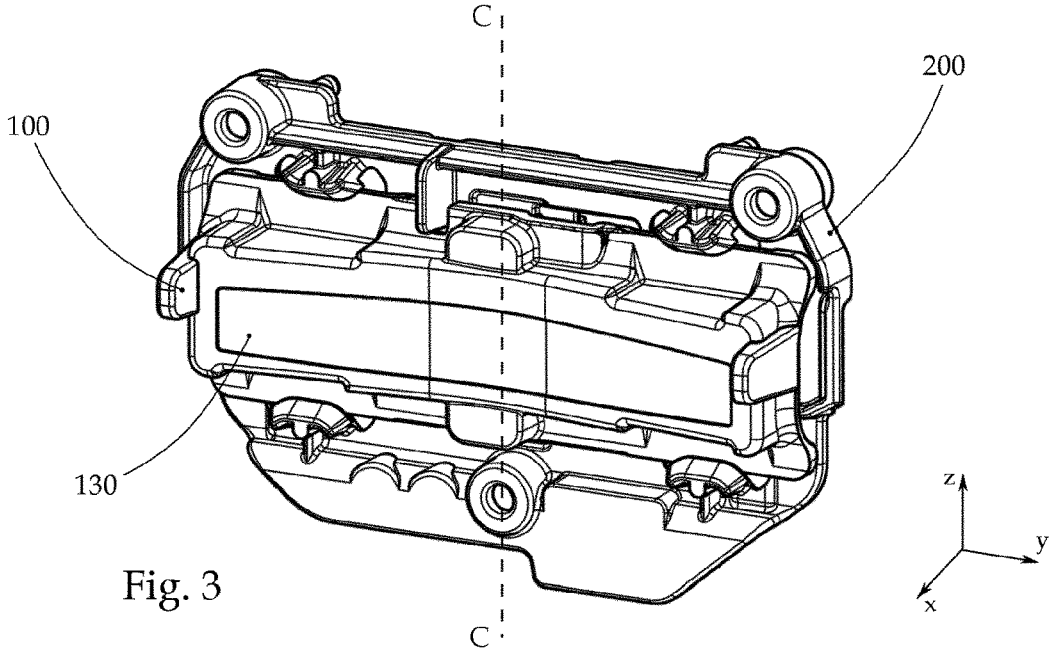
Figure 3A:
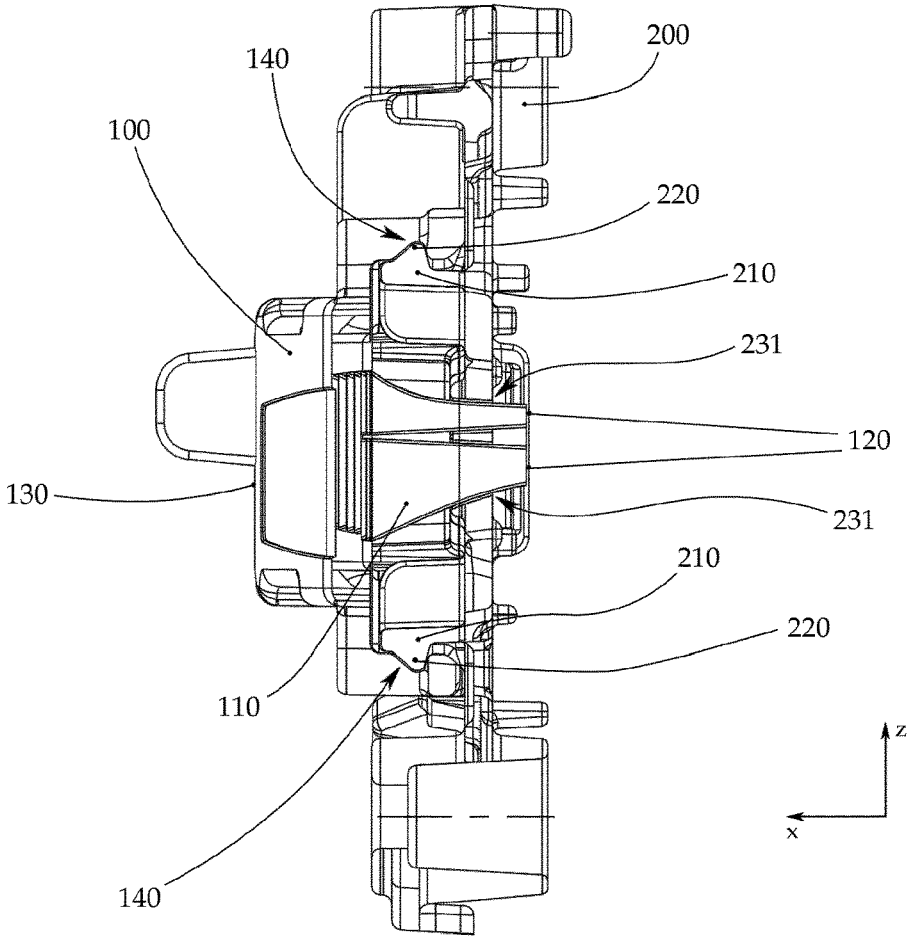
Figure 4:
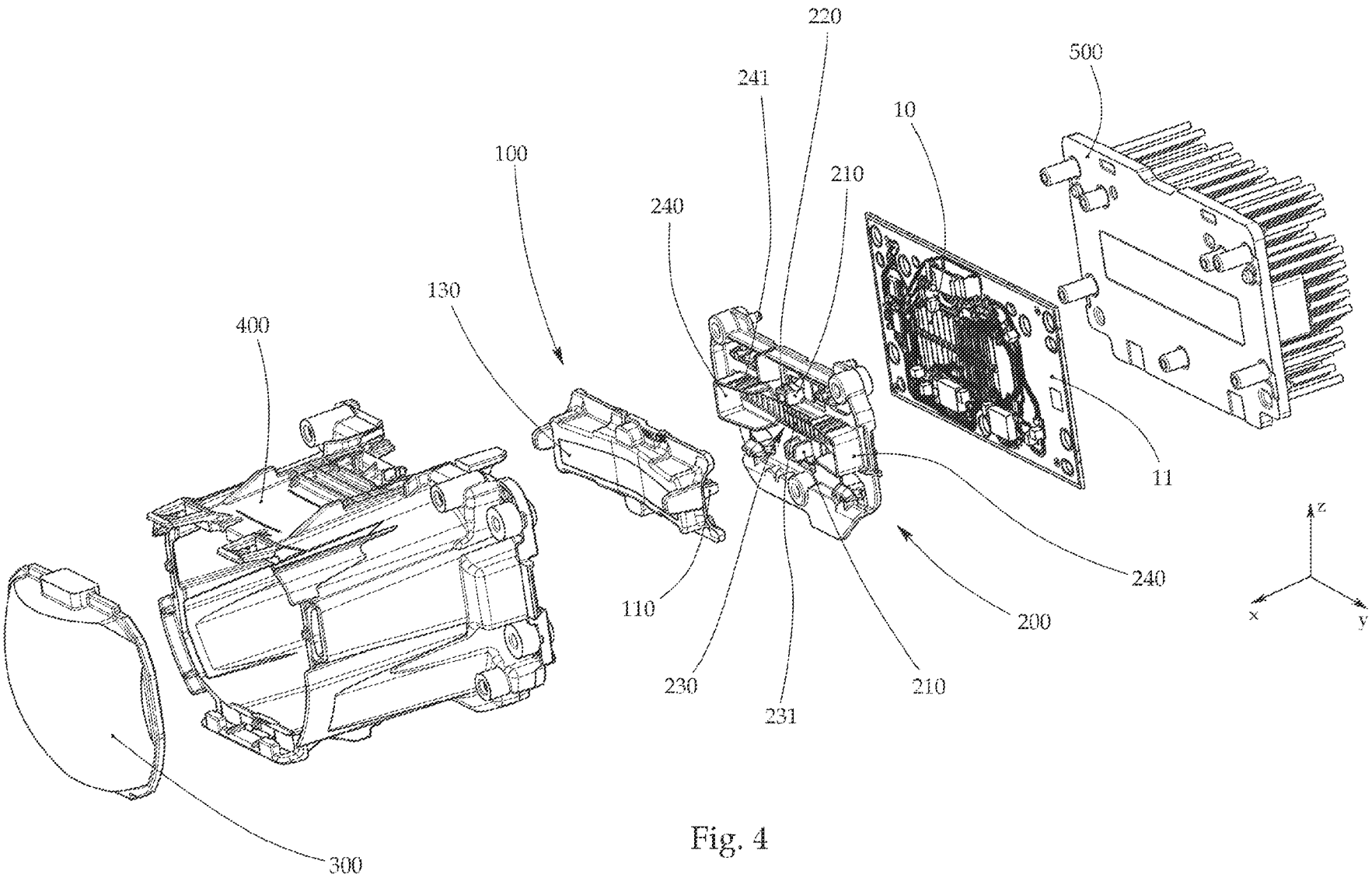

FIG. 1 shows an exemplary illumination device in an exploded illustration, with a holder and a primary optical element, wherein the holder has two latching elements for fixing the primary optical element, FIG. 2 shows the illumination device from FIG. 1 in a view from the rear, FIG. 3 shows the exemplary illumination device from the previous figures in an assembled state, FIG. 3*a* shows the illumination device from FIG. 3 through the section C-C, and FIG. 4 shows an exemplary light module with an illumination device in an exploded illustration.

FIG. 1 shows an exemplary illumination device, which comprises a plurality of light sources 10, which are configured to emit light beams in a main emission direction, a primary optical element 100 having a plurality of light-conducting bodies 110, which light-conducting bodies 110 are arranged in the main emission direction of the light sources 10 and in each case have a light entry face 120 and a light exit face 130, and a holder 200, which holder 200 is configured to hold the light entry faces 120 of the light-conducting bodies 110 in position with respect to the light sources 10. Furthermore, the light-conducting bodies 110 open into a common light exit face 130.

The light sources 10 in each case comprise one or more light-emitting diodes, wherein each light source comprises one or more light-emitting diodes in each case. Preferably, each light source can be controlled and correspondingly switched on and off, preferably also dimmed, separately. If a light source consists of a plurality of light-emitting diodes, it may also be advantageous if each of the light-emitting diodes can be controlled separately.

"Main emission direction" is, in general, to be understood as the direction in which light sources 10 emit light most strongly or most as a consequence of their directionality.

In the figures shown, the main emission direction corresponds to the x direction of the coordinate system respectively drawn in the figures.

Furthermore, the holder 200 has two latching elements 210 constructed with a catch 220 for fastening the primary optical element 100, wherein the catches are configured to engage in an undercut 140 respectively assigned to the catches, which undercut 140 is arranged on the primary optical element 100, but cannot be seen in FIG. 1 owing to the view.

It may however also be possible that more than two latching elements 210 and the assigned undercuts 140 are provided on the primary optical element 100.

In the example of an illumination device shown in the figures, the latching elements 210 are produced in one piece with the holder 200.

The primary optical element 100 is made from a transparent, light-conducting and shapeable plastic, preferably from a silicone material or a poly(organo)siloxane.

Furthermore, It can be seen in FIG. 1—better in FIG. 2 however—that the holder 200 has an accommodating section 230 with openings 231 provided in accordance with the number of light-conducting bodies, which openings 231 are each assigned to a light-conducting body 110 and in which the light-conducting bodies 110 of the primary optical element 100 can be accommodated and positioned, wherein the holder 200 accommodates the light-conducting bodies 110 on its end section facing the light entry faces 120.

Furthermore, the holder 200 has two positioning walls 240 protruding in the main emission direction or x direction, which are configured to engage into a depression 242 provided on the primary optical element 100.

A "positioning wall" is fundamentally to be understood as not only a projection in one plane. This term may also mean a coming together of a plurality of planar walls, which are connected to one another, preferably at their respective lateral end edges, as is shown in the exemplary illumination device in the figures. The individual walls are at right angles to one another here and form a type of open block or a U shape, wherein the connecting edge regions may be rounded.

Furthermore, the individual walls of a positioning wall 240 do not have the same height, wherein gradual height differences or courses can be seen in FIG. 1.

The positioning walls 240 in general ensure a further stability of the primary optical element 100 in the assembled state of the illumination device, so that vibration transverse to the main emission direction or vibration in the y direction can be prevented to the greatest extent possible.

Furthermore, projections 241 may be arranged on the positioning walls 240, which projections 241 extend longitudinally in the direction of the main emission direction or x direction and are configured to engage in a positive-fitting manner into a guide groove 150 in the primary optical element 100 respectively assigned to the projections 241. Such projections 241 bring about an additional stability in a fastened state of the primary optical element 100 on the holder 200.

As is illustrated in FIG. 1, the positioning walls 240 are respectively arranged to the side of or along the y axis of the accommodating section 230, wherein the open sides of the positioning walls 240 are aligned with respect to one another and partially delimit or demarcate the accommodating section 230.

FIG. 2 shows a view from the rear of the illumination device from FIG. 1, wherein it can be seen in FIG. 2 that the light-conducting bodies 110 are constructed longitudinally in the illumination device shown, with a greater extent in the main emission direction of the light beams or the x axis than transversely thereto. Moreover, the light-conducting bodies 110 have a tapering cross section towards their light entry faces 120. Due to the cross sections of the light-conducting bodies 110, which thus increase in size in the main emission direction or x direction, the holder 200 can only be pushed onto the light-conducting bodies 110 up to a certain point.

FIG. 3 shows the assembled state of the illumination device from the previous figures, wherein FIG. 3*a* illustrates a cross-sectional view along the section C-C. Here, it can be seen that the individual light-conducting bodies 110 are precisely accommodated and positioned in the openings 231.

The openings 231 are holes or mounts in the holder, with an exactly matched cross section for the respective light-conducting body 110; these are pushed into the assigned openings 231 and may in this case protrude slightly rearwards out of the openings 231, as can be seen in FIG. 3*a*, or terminate flush with the holder 200 or with the openings 231.

FIG. 4 shows an exemplary light module having an illumination device from the previous figures, wherein the light module additionally comprises a printed circuit board 11, on which the light sources 10 are arranged, a heat sink 500, which is configured to remove the heat created during operation of the light sources, a secondary optical element 300 and a housing 400, which is provided to accommodate the remaining components, wherein the secondary optical element is configured to shape the light beams emanating from the light exit face 130 of the illumination device, in order to obtain a desired light distribution, for example a dipped beam and/or a main beam distribution, wherein yet other or further light distributions are possible.

In the assembled state of the light module, the printed circuit board 11 having light sources 10 is held between the heat sink 500 and the holder 200, wherein pins arranged on the heat sink pass through the printed circuit boards through openings provided therefor.

REFERENCE LIST

| | |
|---|---|
| Light sources | 10 |
| Printed circuit board | 11 |
| Primary optical element | 100 |
| Light-conducting body | 110 |
| Light entry face | 120 |
| Light exit face | 130 |
| Undercut | 140 |
| Holder | 200 |

-continued

| REFERENCE LIST | |
|---|---|
| Latching element | 210 |
| Catch | 220 |
| Accommodating section | 230 |
| Opening | 231 |
| Positioning wall | 240 |
| Projection | 241 |
| Secondary optical element | 300 |
| Housing | 400 |
| Heat sink | 500 |

The invention claimed is:

1. An illumination device for a motor-vehicle headlamp, the illumination device comprising:

a plurality of light sources (10), which are configured to emit light beams in a main emission direction:

a primary optical element (100) having a plurality of light-conducting bodies (110), which light-conducting bodies (110) are arranged in the main emission direction of the light sources (10) and respectively have a light entry face (120), into which the light beams of the light sources can be fed, and a common light exit face (130), the light-conducting bodies (110) opening into the common light exit surface (130); and a holder (200), which is configured to hold the light entry faces (120) of the light-conducting bodies (110) in position with respect to the light sources (10), wherein the holder (200) has at least one latching element (210) for fastening the primary optical element (100), wherein the latching element (210) is configured to engage in a mating latching element (140) provided on the primary optical element (100), which is assigned to the latching element (210), wherein the holder (200) has at least one positioning wall (240) protruding in the main emission direction, which is configured to engage into a depression (242) provided on the primary optical element (100), wherein the at least one positioning wall (240) has at least one projection (241) which extends longitudinally in the direction of the main emission direction and is configured to engage in a positive-fitting manner into a guide groove (150) in the depression in the primary optical element (100), which is assigned to the at least one projection (241), and wherein the primary optical element (100) is made in one piece from a transparent, light-conducting and shapeable plastic, and wherein the primary optical element (100) is made from a silicone material.

2. The illumination device according to claim 1, wherein the at least one latching element (210) has a catch (220).

3. The illumination device according to claim 1, wherein the mating latching element (140) is constructed as an undercut (140).

4. The illumination device according to claim 1, wherein the at least one latching element (210) is produced in one piece with the holder (200).

5. The illumination device according to claim 1, wherein the holder (200) has an accommodating section (230) having at least one opening (231), in which the light-conducting bodies (110) can be accommodated and positioned, wherein the holder (200) has openings (231) in accordance with the number of the light-conducting bodies (110), which are each assigned to a light-conducting body (110).

6. The illumination device according to claim 1, wherein, in the main emission direction, the at least one positioning wall (240) is arranged to the side of the accommodating section (230) of the holder (200).

7. The illumination device according to claim 1, wherein the light-conducting bodies (110) are of elongated construction, with a larger extent in the main emission direction of the light beams than transversely thereto.

8. The illumination device according to claim 1, wherein the light-conducting bodies (110) have a cross section that tapers towards their light entry faces (120).

9. The illumination device according to claim 1, wherein each light source of the plurality of light sources (10) comprises one or more light-emitting diodes.

10. A light module having at least one illumination device according to claim 1.

11. A motor vehicle headlamp having at least one light module according to claim 10.

12. The illumination device according to claim 1, wherein the silicone material comprises a poly(organo)siloxane.

* * * * *